US012760738B2

(12) United States Patent
Levy et al.

(10) Patent No.: US 12,760,738 B2
(45) Date of Patent: Oct. 13, 2026

(54) MAGNETIC ROTOR DESIGNS AND SYSTEMS

(71) Applicant: Healey Magnetics, LLC, Atlanta, GA (US)

(72) Inventors: Evan Levy, Atlanta, GA (US); John R. Culp, Atlanta, GA (US)

(73) Assignee: Healey Magnetics, LLC, Atlanta, GA (US)

( * ) Notice: Subject to any disclaimer, the term of this patent is extended or adjusted under 35 U.S.C. 154(b) by 0 days.

(21) Appl. No.: 18/798,894

(22) Filed: Aug. 9, 2024

(65) Prior Publication Data

US 2025/0059977 A1 Feb. 20, 2025

Related U.S. Application Data

(60) Provisional application No. 63/551,630, filed on Feb. 9, 2024, provisional application No. 63/519,607, filed on Aug. 15, 2023.

(51) Int. Cl.
*F04D 13/02* (2006.01)
*F04D 3/00* (2006.01)
(Continued)

(52) U.S. Cl.
CPC ..... *F04D 13/024* (2013.01); *F04D 3/00* (2013.01); *F04D 29/046* (2013.01); *F04D 29/181* (2013.01)

(58) Field of Classification Search
CPC ..... F04D 13/024; F04D 3/00; F04D 29/046; F04D 29/181; H02K 16/00; H02K 16/02;
(Continued)

(56) References Cited

U.S. PATENT DOCUMENTS 2,243,555 A 5/1941 Faus
2,722,617 A 11/1955 Meyer et al.
(Continued)

FOREIGN PATENT DOCUMENTS

DE 102008060284 A1 6/2010
WO WO-2010089465 A1 * 8/2010 ..... H02K 49/102

OTHER PUBLICATIONS

International Preliminary Report on Patentability for International Application No. PCT/US2013/037518 dated Dec. 4, 2014.
(Continued)

*Primary Examiner* — Mark A Laurenzi
*Assistant Examiner* — Benjamin Doyle
(74) *Attorney, Agent, or Firm* — Potomac Law Group, PLLC; Douglas E. Ringel

(57) ABSTRACT

In some embodiments, a fluid-flow system comprises an internal magnetic array coupled to at least one set of rotor blades. The internal magnetic array comprises magnets arranged to provide alternating polarity around its periphery. The system may further comprise at least one external magnet. The internal magnetic array and the at least one external magnet are arranged such that actuation of one magnetically induces actuation of the other. In some embodiments, actuation of the at least one external magnet induces, though magnetic coupling, rotation of the internal magnetic array, thereby causing rotation of the at least one set of rotor blades to drive a fluid flow. In some embodiments, a fluid flow through the at least one set of rotor blades induces rotation of the internal magnetic array and actuation of the at least one external magnet. In other embodiments, a step-up or step-down system is provided by magnetic coupling. In other embodiments, a magnetic array is in the form of a star shape or non-convex polygon.

23 Claims, 5 Drawing Sheets

(51) Int. Cl.
*F04D 29/046* (2006.01)
*F04D 29/18* (2006.01)

(58) Field of Classification Search
CPC .... H02K 1/2791; H02K 1/2733; H02K 51/00; H02K 1/27; H02K 49/102; H02K 15/03; H02K 49/106
USPC ..... 310/152, 156
See application file for complete search history.

(56) References Cited

U.S. PATENT DOCUMENTS 3,523,204 A * 8/1970 Sydney ..... H02K 49/102 310/94
3,730,488 A 5/1973 Gardner, Jr.
3,814,962 A * 6/1974 Baermann ..... H02K 49/102 310/103
3,864,587 A * 2/1975 Landry ..... H02K 49/102 74/DIG. 4
4,082,969 A * 4/1978 Kelly ..... H02K 49/102 310/80
4,563,604 A 1/1986 Xuan
4,850,821 A * 7/1989 Sakai ..... F04D 13/14 310/152
5,569,967 A * 10/1996 Rode ..... H02K 15/03 310/83
6,047,456 A * 4/2000 Yao ..... H02K 49/102 29/407.05
6,087,751 A * 7/2000 Sakai ..... H02K 1/246 310/191
6,411,001 B1 * 6/2002 Henderson ..... F04D 25/026 310/156.01
7,024,963 B2 4/2006 French
7,777,377 B2 * 8/2010 Tkadlec ..... H02K 49/102 310/80
7,898,134 B1 3/2011 Shaw
8,598,763 B2 * 12/2013 Aota ..... H02K 1/276 310/156.56
9,077,224 B2 * 7/2015 Morishita ..... H02K 1/2766
9,197,117 B2 11/2015 Levy
9,287,761 B2 * 3/2016 Reinosa ..... H02K 49/102
9,564,780 B2 * 2/2017 Tsutsui ..... H02K 1/2766
9,954,405 B2 4/2018 Levy
10,224,798 B2 * 3/2019 Leas ..... H02K 49/102
11,025,153 B2 * 6/2021 Pureepaswong ..... H02K 53/00
2002/0158531 A1 10/2002 Aritaka
2004/0041479 A1 * 3/2004 French ..... H02K 49/102 310/105
2004/0066107 A1 * 4/2004 Gery ..... H02K 49/106 310/114
2004/0095034 A1 * 5/2004 Popov ..... H02K 1/2766 310/156.56
2006/0091748 A1 * 5/2006 Yoda ..... H02K 49/102 310/83
2006/0123936 A1 * 6/2006 French ..... H02K 49/102 74/63
2007/0057589 A1 * 3/2007 Tatematsu ..... H02K 1/2766 310/156.53
2008/0203831 A1 * 8/2008 French ..... H02K 51/00 310/46
2009/0047155 A1 * 2/2009 Hsieh ..... F04D 25/026 417/420
2009/0189470 A1 7/2009 McClellan
2009/0243414 A1 10/2009 Lamas
2013/0099615 A1 * 4/2013 Stewart ..... H02K 49/102 310/101
2013/0278102 A1 * 10/2013 Levy ..... H02K 51/00 310/114
2016/0043600 A1 2/2016 Levy
2016/0172947 A1 * 6/2016 Kusakabe ..... H02K 21/14 310/156.53
2020/0244121 A1 * 7/2020 Takahashi ..... H02K 21/14

OTHER PUBLICATIONS

International Search Report and Written Opinion for International Application No. PCT/US2013/037158 dated Nov. 21, 2014.
Unknown, "Spinning Dipoles: Interaction of Two Spinning Dipoles," http://jcmax/pbworks.com/w/page/4617991/SpinningDipoles, 7 pgs, Aug. 2008.
Unknown, "Why Are There So Many Different Shapes of Magnets," Amazing Magnets, http://strong-rare-earth-magnets.com/why-are-there-so many-different-shapes-of-magnets, 2 pgs, Jul. 2012.

* cited by examiner

MAGNETIC ROTOR DESIGNS AND SYSTEMS

CROSS-REFERENCE TO RELATED APPLICATIONS

This application claims priority to U.S. Provisional Patent Application No. 63/519,607, filed Aug. 15, 2023, entitled "Fluid-Flow Systems with Magnetic Rotor Assemblies," and U.S. Provisional Patent Application No. 63/551,630, filed Feb. 9, 2024, entitled "Magnetic Rotor Designs and Systems," the entire contents of which are incorporated herein by reference.

TECHNICAL FIELD

The present disclosure relates to the field of magnetic rotors. In some examples, the disclosure relates to fluid-flow systems, including systems in which a rotor assembly drives a fluid flow and systems in which a rotor assembly is driven by a fluid flow. In other examples, the disclosure relates to magnetic rotor designs that may be used as a step-up or step-down arrangements and/or magnetic rotor designs for a variety of applications.

BACKGROUND OF THE INVENTION

Typical fluid-flow systems have one or more drawbacks. For example, the design of known fluid-flow systems can present one or more issues including but not limited to limitations on performance, mechanical complications, excess power requirements, disturbance of fluid flow, potential for leakage, potential for contamination, excess wear, excess weight, excess cost, reduced service life, and/or increased need for service, repair, and/or replacement of parts. There is a need for improvements in fluid-flow systems to overcome one or more of these drawbacks of known systems.

Typical gear systems have one or more drawbacks. For example, some known systems for changing operational speeds use gear boxes that rely on toothed gears that are mechanically engaged. This presents issues that impact performance, most notably friction and wear on gear teeth. These issues reduce the efficiency of power transfer and increase the need for service, repair, and/or replacement of parts. There is a need for improvements over mechanical gear systems to overcome one or more of these drawbacks of known system.

There is also a need for improvements in magnetic rotor designs, for a variety of applications. Improvements in magnetic rotor designs can result in advantages in operation, efficiency, power, torque, energy savings, service life, and/or other aspects.

SUMMARY OF THE INVENTION

In some embodiments, a fluid-flow system comprises a fluid-flow assembly comprising an internal magnetic array coupled to at least one set of rotor blades, wherein the internal magnetic array comprises magnets arranged to provide alternating polarity around the outside of the internal magnetic array. The system may further comprise a driving assembly comprising at least one external magnet, wherein the internal magnetic array and the at least one external magnet are not in physical contact with each other, and wherein the internal magnetic array and the at least one external magnet are arranged such that actuation of the at least one external magnet magnetically induces rotation of the internal magnetic array. The internal magnetic array and the at least one set of rotor blades may be arranged such that rotation of the internal magnetic array causes rotation of the at least one set of rotor blades, causing a fluid to flow.

The fluid-flow assembly may include an outer tube housing the at least one set of rotor blades. The fluid-flow assembly may be configured to direct fluid flow generally in an axial direction, parallel to an axis of the outer tube and parallel to an axis of rotation of the at least one set of rotor blades. The fluid-flow assembly may be configured to allow rotation of the internal magnetic array and the at least one set of rotor blades without the need for a drive shaft inside the outer tube.

The fluid-flow assembly may include a bearing assembly allowing the internal magnetic array to rotate relative to the outer tube. The bearing assembly may be a ring bearing. The bearing assembly may support a shaft structure. The shaft structure may be rotatable relative to the outer tube or fixed relative to the outer tube. The shaft structure may establish an axis of rotation for the internal magnetic array and the at least one set of rotor blades.

In some embodiments, the at least one external magnet comprises an external magnetic array comprising magnets arranged to provide alternating polarity around the outside of the external magnetic array. Actuation of the at least one external magnet may comprise rotation of the external magnetic array, thereby magnetically inducing rotation of the internal magnetic array.

In some embodiments, the at least one external magnet comprises at least one electromagnet. Actuation of the at least one external magnet may comprise passing current through the at least one electromagnet to magnetically induce rotation of the internal magnetic array.

In some embodiments, the fluid-flow system may further comprise a second driving assembly comprising at least one second external magnet. In some embodiments, the internal magnetic array and the at least one second external magnet are arranged such that actuation of the at least one second external magnet magnetically induces rotation of the internal magnetic array. In some embodiments, the fluid-flow system may further comprise a second fluid-flow assembly comprising a second internal magnetic array, wherein the second internal magnetic array and the at least one external magnet are arranged such that actuation of the at least one external magnet magnetically induces rotation of the second internal magnetic array.

In some embodiments, a fluid-flow system comprises a fluid-flow assembly comprising an internal magnetic array coupled to at least one set of rotor blades, wherein the internal magnetic array comprises magnets arranged to provide alternating polarity around the outside of the internal magnetic array. The system may further comprise at least one external magnet. The internal magnetic array and the at least one external magnet may be arranged such that when the internal magnetic array is rotated, the rotation of the internal magnetic array magnetically induces actuation of the external magnetic array. The internal magnetic array and the at least one set of rotor blades may be arranged such that a fluid flow that causes rotation of the at least one set of rotor blades results in rotation of the internal magnetic array, thereby inducing actuation of the at least one external magnet.

In some embodiments, a magnetic rotor system comprises a first magnetic array comprising magnets arranged to provide alternating polarity around the outside of the first magnetic array and a second magnetic array comprising magnets arranged to provide alternating polarity around the outside of the second magnetic array. The first magnetic array and the second magnetic array are not in physical contact with each other. The first magnetic array and the second magnetic array are arranged such that when the first magnetic array is rotated, the rotation of the first magnetic array magnetically induces rotation of the second magnetic array. The first magnetic array has a first number of polarity changes around the outside of the first magnetic array, while the second magnetic array has a second number of polarity changes around the outside of the second magnetic array. In some embodiments, the second number of polarity changes differs from the first number of polarity changes.

In some embodiments, the first number of polarity changes is greater than the second number of polarity changes. Rotation of the first magnetic array at a first rotational velocity drives rotation of the second magnetic array at a second rotational velocity that is higher than the first rotational velocity.

In some embodiments, the first number of polarity changes is smaller than the second number of polarity changes. Rotation of the first magnetic array at a first rotational velocity drives rotation of the second magnetic array at a second rotational velocity that is lower than the first rotational velocity.

In some embodiments, a magnetic rotor comprises a magnetic array comprising magnets arranged to provide alternating polarity around the outside of the magnetic array, wherein at least one of the magnets in the magnetic array has an axis that is angled with respect to a radius from the rotational center of the magnetic array. In some embodiments, the magnets in the magnetic array form a star shape. In some embodiments, the magnets in the magnetic array form a non-convex polygon.

Other embodiments are possible consistent with the disclosure and the principles disclosed herein.

DETAILED DESCRIPTION

The inventions described herein build upon the inventions and principles disclosed in U.S. Pat. Nos. 9,197,117 and 9,954,405, the disclosures of which are hereby incorporated by reference herein in their entirety.

Some embodiments of the inventions described herein relate to fluid-flow systems, including systems in which a rotor assembly drives a fluid flow and systems in which a rotor assembly is driven by a fluid flow. The term "fluid" as used herein embraces gases and liquids, including, for example, air, oxygen, water, saline solution, fuel such as gasoline, mixtures of air and fuel, and any other suitable fluid. The term "rotor" as used herein embraces devices or parts that spin or rotate.

Figure 1:
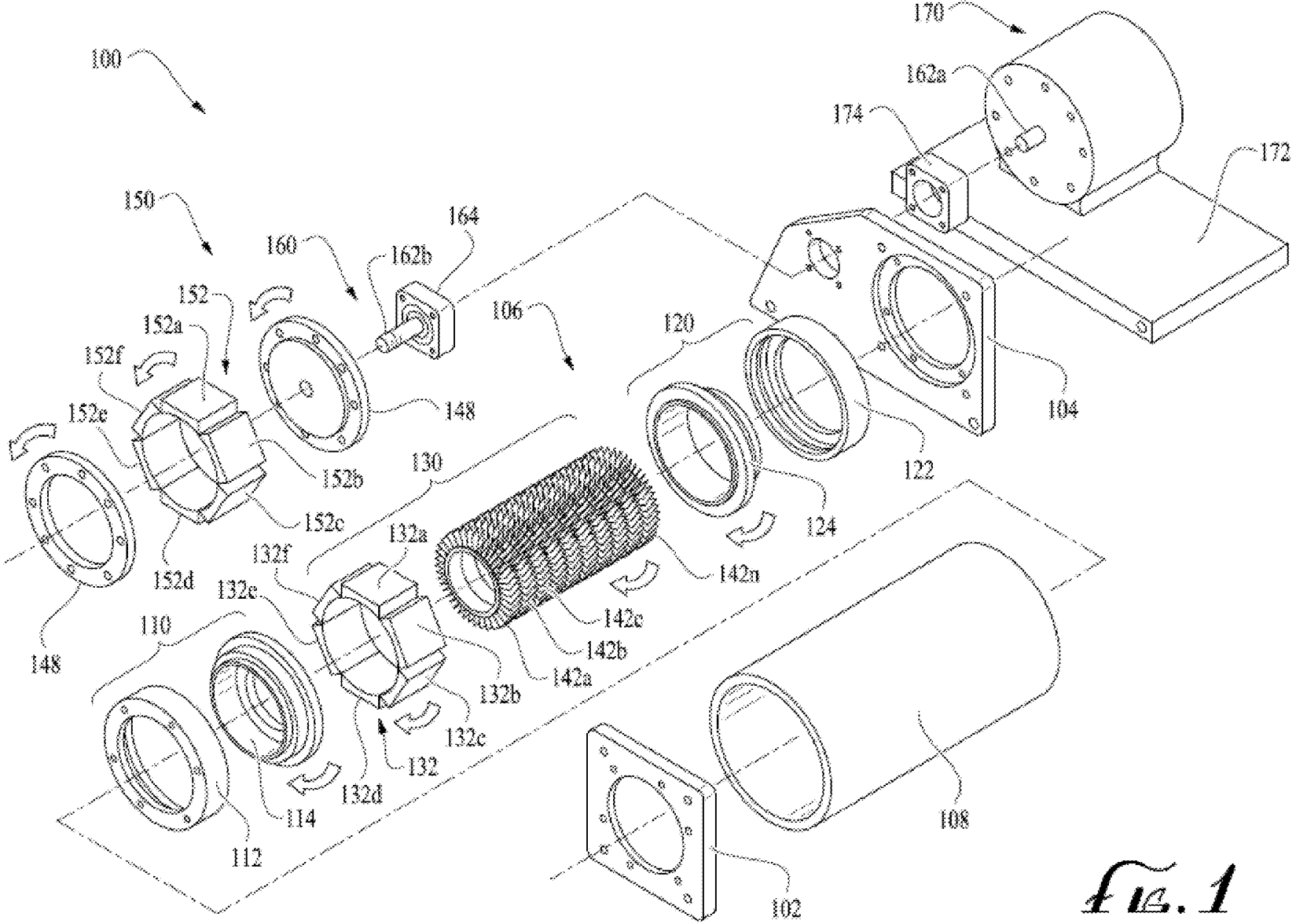
FIG. 1 shows an exploded view of a first example of a fluid-flow system with a magnetic rotor assembly.

FIG. 1 shows an exploded view of a first example of a fluid-flow system 100 including a fluid-flow assembly 106 having a magnetic rotor assembly 130.

The fluid-flow assembly 106 includes an outer tube 108. The outer tube 108 may be constructed of any suitable material. In some embodiments, the outer tube 108 may be made of a non-conductive material, such as a suitable plastic, polycarbonate, composites, ceramics, carbon fiber, titanium, etc.

The outer tube 108 is connected at a first end to a first end support 102 and at a second end to a second end support 104. Each end support 102, 104 may be in any suitable form, such as a plate or bracket. The first end support 102 and the second end support 104 may be constructed of any suitable material. In some embodiments, the first end support 102 and the second end support 104 may be made of a suitable non-conductive material, such as any of the non-conductive materials previously mentioned. The first end support 102 and the second end support 104 may be connected to the outer tube 108 in any suitable manner, for example by fasteners, gluing, welding, crimping gasket, or any other suitable manner. In alternative embodiments, the first end support 102 and/or the second end support 104 may be manufactured integrally in one piece with the outer tube 108.

The fluid-flow assembly 106 further includes a first bearing assembly 110 comprising a fixed bearing support 112 and a rotating bearing support 114 and a second bearing assembly 120 comprising a fixed bearing support 122 and a rotating bearing support 124. The bearing assemblies 110, 120 may be any suitable type of bearing assembly, including but not limited to ball bearing, roller bearing, ring bearing, thrust bearing, magnetic bearing, sliding bearing, or any other suitable bearing that permits suitable rotation of the rotating bearing support 114, 124 relative to the respective fixed bearing support 112, 122. For example, a set of ball bearings may be positioned and housed between the rotating bearing support 114, 124 and its respective fixed bearing support 112, 122, allowing the rotating bearing support 114, 124 to rotate effectively relative to the respective fixed bearing support 112, 122. The bearing assemblies 110, 120 may be constructed of any suitable material.

The fluid-flow assembly 106 further includes a rotor assembly 130. The rotor assembly 130 includes an internal magnetic array 132 and a one or more sets of rotor blades 142*a* through 142*n*. The term "internal" refers to the fact that the magnetic array 132 is associated with the one or more sets of rotor blades 142*a* through 142*n* in the fluid flow stream.

The internal magnetic array 132 includes an array of magnets 134*a* through 134*f*, wherein the magnets 134*a* through 134*f* are arranged to provide alternating polarity around the outside of the internal magnetic array 132 and consequently the rotor assembly 130. For example, magnets 134*a*, 134*c*, and 134*e* may have outwardly-facing surfaces of north polarity and inwardly-facing surfaces of south polarity, while magnets 134*b*, 134*d*, and 134*f* may have outwardly-facing surfaces of south polarity and inwardly-facing surfaces of north polarity. The magnets may be made of any suitable type of magnet, such as permanent magnets made of neodymium (an alloy of neodymium, iron, and boron). Many variations are possible, including changes to the number, size, shape, and material of the magnets.

Each set 142*a* through 142*n* of rotor blades comprises a plurality of blades or vanes extending outwardly from a central axis. Each blade or vane is shaped and positioned to push fluid (gas or liquid) when rotated. In the illustrated example, each set 142*a* through 142*n* of rotor blades is aligned for rotation around a common central axis. The sets 142*a* through 142*n* of rotor blades may have any form and arrangement suitable for the desired application. In some applications, movement or an increase in velocity and/or acceleration of the fluid is desired. In some applications, each set of rotor blades is designed to draw in input fluid and compress that fluid into the space behind the set or rotor blades. A series of successive sets of rotor blades may be designed to successively compress the fluid more and more at each set until a desired compression is reached. The rotor blades may be constructed of any suitable material. In some embodiments, the rotor blades may be made of a suitable non-conductive material, such as any of the non-conductive materials previously mentioned. In certain embodiments, the rotor blades may be connected to each other at a central hub, an outer ring, and/or at an intermediate area along the radial extent of the blades. Rotor blade materials and designs may differ depending on fluid (gas or liquid) type and mechanical or operational requirements or conditions.

In addition to the fluid-flow assembly 106, the system 100 further includes a driving assembly 150. The driving assembly 150 comprises a motor 170, a drive shaft structure 160, and at least one external magnet. In the illustrated embodiment, the at least one external magnet comprises an external magnetic array 152. The term "external" refers to the fact that the at least one magnet or magnetic array 152 is outside of the internal magnetic array 132.

The external magnetic array 152 includes an array of magnets 154*a* through 154*f*, wherein the magnets 154*a* through 154*f* are arranged to provide alternating polarity around the outside of the external magnetic array 152. For example, magnets 154*a*, 154*c*, and 154*c* may have outwardly-facing surfaces of south polarity and inwardly-facing surfaces of north polarity, while magnets 154*b*, 154*d*, and 154*f* may have outwardly-facing surfaces of north polarity and inwardly-facing surfaces of south polarity. The magnets may be made of any suitable type of magnet, such as permanent magnets made of neodymium (an alloy of neodymium, iron, and boron). Many variations are possible, including changes to the number, size, shape, and material of the magnets.

The external magnetic array 152 and/or the internal magnetic array 132 may be mounted to one or more mounting supports 148. Each mounting support 148 may be in any suitable form, such as a plate or bracket.

The drive shaft structure 160 may include a single drive shaft or a series of drive shaft segments, which may be continuous or separate. In the case of drive shaft segments, the drive shaft segments may be connected together directly or indirectly through one or more other components such as gears, supports, parts of rotor assemblies, or other components. In the example system 100 of FIG. 1, the drive shaft structure includes a drive shaft segment 162*a* extending from the motor 170 and a drive shaft segment 162*b* extending from a housing 164. The drive shaft structure 160 is connected to the external magnetic array 152 and/or one or more of the mounting supports 148 for the external magnetic array 152 so that rotation of the drive shaft structure 160 rotates the external magnetic array 152. The housing 164 may be connected to the second end support 104. The connection may be in any suitable manner, for example by fasteners, gluing, welding, or any other suitable manner. In some embodiments, the housing 164 may be manufactured integrally in one piece with the second end support 104.

The motor 170 is capable of driving the drive shaft structure 160 and consequently rotating the external magnetic array 152. The motor 170 may be mounted to a support 172. The motor support 172 may be connected to the second end support 104. The connection may be in any suitable manner, for example by fasteners, gluing, welding, or any other suitable manner. In some embodiments, the motor support 172 may be manufactured integrally in one piece with the second end support 104. The motor support 172 may include a mounting element 174 to facilitate alignment and/or connection of the motor 170 with the external magnetic array 152.

When the fluid-flow assembly 106 is assembled, the first bearing assembly 110, the second bearing assembly 120, and the rotor assembly 130 are mounted within the outer tube 108. The fixed bearing supports 112, 122 are connected to the outer tube 108 such that they do not move relative to the outer tube 108, while the rotating bearing supports 114, 124 are free to rotate within the outer tube 108. The rotor assembly 130 is connected to the rotating bearing supports 114, 124 such that the rotor assembly 130 rotates with the rotating bearing supports 114, 124. The rotor assembly 130 may be connected to the rotating bearing supports by a connection at the internal magnetic array 132, at one or more of the sets of rotor blades 142*a* through 142*n*, and/or at another part of the rotor assembly 130. In some embodiments, one or more of the sets of rotor blades 142*a* through 142*n* may be mounted wholly or partially inside the internal magnetic array 132 and/or wholly or partially inside one or both of the bearing assemblies 110, 120. In some embodiments, one or more of the sets of rotor blades 142*a* through 142*n* may be mounted next to the internal magnetic array 132.

When the system 100 is assembled, the outer tube 108 (with the first bearing assembly 110, the second bearing assembly 120, and the rotor assembly 130 mounted within the outer tube 108) is connected to the first end support 102 and the end support plate 104. The second end support 104 is in turn connected to the motor support 172. When the driving assembly 150 is assembled, the external magnetic array 152 and the mounting supports 148 associated with the external magnetic array 152 are connected for rotation by the drive shaft structure 160, driven by the motor 170.

Additional components may be incorporated depending on the application. For example, tubing and/or an inlet valve may be connected upstream of the first end of the outer tube 108. Tubing and/or an outlet valve may be connected downstream of the second end of the outer tube 108. Other components may be incorporated for supplying, directing, controlling, and/or utilizing the fluid directed into or out of the sets of rotor blades 142*a* through 142*n*.

In use, the motor 170 is used to rotate the external magnetic array 152. The external magnetic array 152 does not physically contact but is magnetically coupled to the internal magnetic array 132 inside the outer tube 108, such that rotation of the external magnetic array 152 causes rotation of the internal magnetic array 132. The action of the external magnetic array 152 upon the internal magnetic array 132 is due to the magnetic forces and occurs without physical contact between the arrays. The internal magnetic array 132 is caused to rotate within the outer tube 108 without the need for mechanical coupling of the internal magnetic array 132 to any drive mechanism. For example, the internal magnetic array 132 is caused to rotate within the outer tube 108 without the need for a drive shaft or other driving component located within the outer tube 108 or within the fluid flow stream at all.

The rotation of the internal magnetic array 132 causes rotation of the sets of rotor blades 142*a* through 142*n*, causing the desired fluid flow. In the illustrated embodiment, the fluid flow is axial, generally in the direction of the axis of the outer tube 108 and the axis of rotation of the sets of rotor blades 142*a* through 142*n*.

In alternative embodiments, the driving assembly comprises at least one external magnet, and the at least one external magnet comprises at least one electromagnet. For example, in some embodiments the at least one external magnet may comprise a plurality of electromagnets arranged around the outside of the internal magnetic array. In this example, actuation of the at least one external magnet comprises passing current through the plurality of electromagnets to magnetically induce rotation of the internal magnetic array. The current in a single magnetic array may be passed in one direction for one polarity and in an opposite direction for opposite polarity. For example, the current may be passed through the electromagnets rapidly in a sequence that simulates the effect of an external magnetic array as described above. In some embodiments the at least one external magnet may comprise a single electromagnet suitably positioned (e.g., like the illustrated external magnetic array 152) and suitably actuated (e.g., with alternating current to simulate the action of rotation of the illustrated external magnetic array 152) to magnetically induce rotation of the internal magnetic array.

Figure 2:
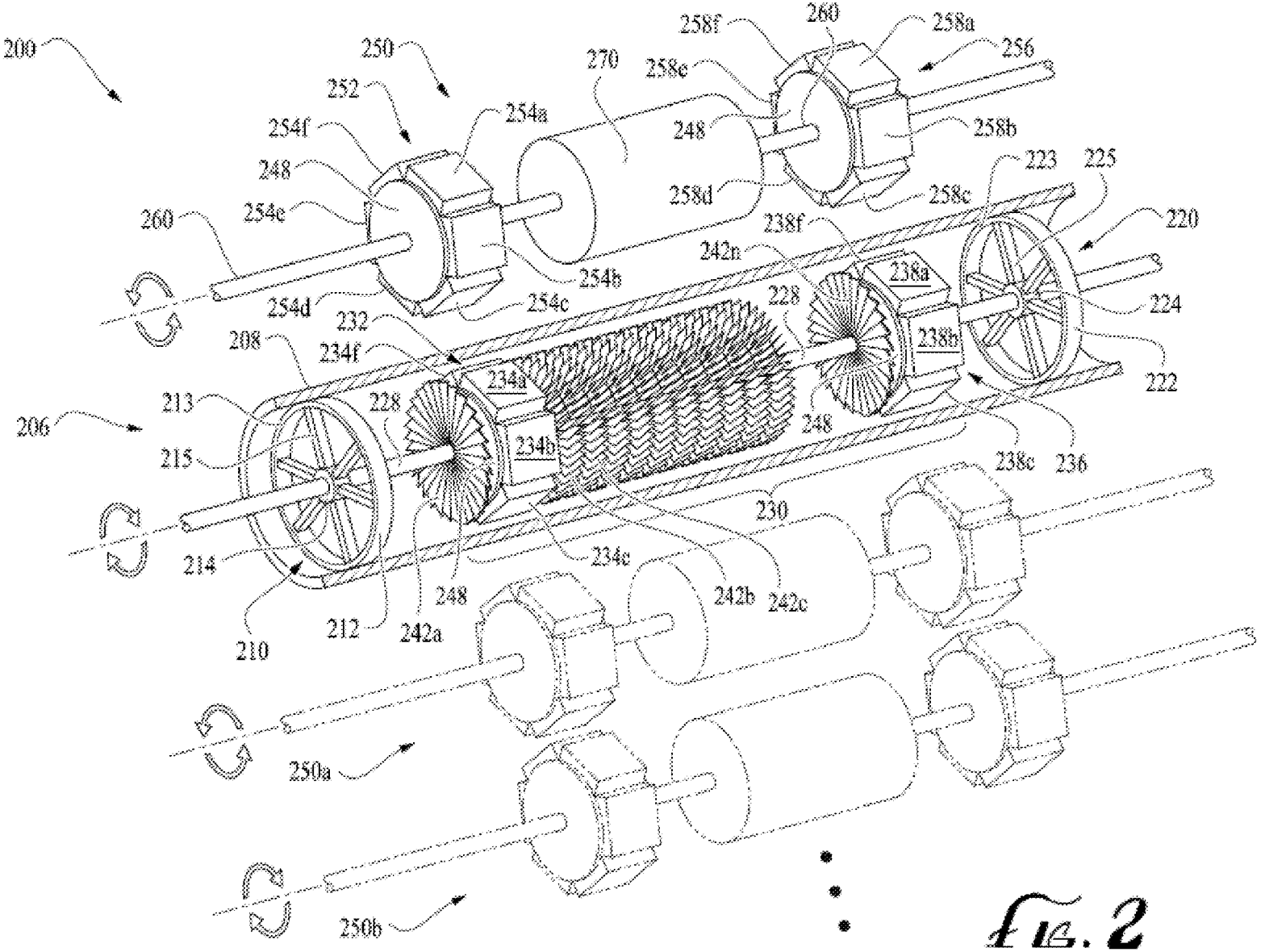
FIG. 2 shows a perspective view, partially in cross-section, of a second example of a fluid-flow system with a magnetic rotor assembly.

FIG. 2 shows a perspective view, partially in cross-section, of a second example of a fluid-flow system 200 including a fluid-flow assembly 206 having a magnetic rotor assembly 230.

The fluid-flow assembly 206 includes an outer tube 208. The outer tube 208 may be constructed of any suitable material. In some embodiments, the outer tube 208 may be made of a suitable non-conductive material, such as any of the non-conductive materials previously mentioned. Like the other tube 108, the outer tube 208 may be connected at its ends to supports such as plates, brackets, or other structure, or integrally formed with such other structure.

The fluid-flow assembly 206 further includes a first bearing assembly 210 comprising a fixed bearing support 212 and a second bearing assembly 220 comprising a fixed bearing support 222. The bearing assemblies 210, 220 support a shaft structure 228. The shaft structure 228 may include a single shaft or a series of shaft segments, which may be continuous or separate. In the case of shaft segments, the shaft segments may be connected together directly or indirectly through one or more other components such as gears, supports, parts of rotor assemblies, or other components. In the example system 200 of FIG. 2, the shaft structure 228 includes a single drive shaft extending through each of the bearing assemblies 210, 220 and the rotor assembly 230.

In the example system 200 in FIG. 2, the fixed bearing supports 212, 222 are in the form of an outer ring 213, 223 fixed to the outer tube 208 with a series of spokes 215, 225 connecting the outer ring 213, 223 to a central hub 214, 224. In this example, the central hub 214, 224 is fixed while the shaft or shaft segments 228 rotate within the central hub 214, 224. In one example, ball bearings within the central hub 214, 224 permit rotation of the shaft or shaft segments 228. In other examples, the bearing assembly may be any other suitable type of bearing assembly, including but not limited to a roller bearing, ring bearing, thrust bearing, magnetic bearing, sliding bearing, or any other suitable bearing that permits suitable rotation of the shaft or shaft segments 228 relative to the fixed bearing supports 212, 222. The bearing assemblies 210, 220 may be constructed of any suitable material.

In an alternative example, the shaft structure 228 does not rotate and a suitable bearing assembly mounted on the shaft structure 228 and connected to the rotor assembly 230 permits rotation of the rotor assembly 230 around the shaft structure 228. Thus, whether the shaft structure itself rotates, the rotor assembly 230 is rotatable within the outer tube 208.

The rotor assembly 230 includes a first internal magnetic array 232, a second internal magnetic array 236, and one or more sets of rotor blades 242*a* through 242*n*. The first internal magnetic array 232, like internal magnetic array 132, includes an array of magnets 234*a* through 234*f*, wherein the magnets 234*a* through 234*f* are arranged to provide alternating polarity around the outside of the internal magnetic array 232 and consequently the rotor assembly 230. For example, magnets 234*a*, 234*c*, and 234*c* may have outwardly-facing surfaces of north polarity and inwardly-facing surfaces of south polarity, while magnets 234*b*, 234*d*, and 234*f* may have outwardly-facing surfaces of south polarity and inwardly-facing surfaces of north polarity. The magnets may be made of any suitable type of magnet, such as permanent magnets made of neodymium (an alloy of neodymium, iron, and boron). Many variations are possible, including changes to the number, size, shape, and material of the magnets. The internal magnetic array 236 is similar to the internal magnetic array 232, with an array of magnets 238*a* through 238*f* that are similar in description and arrangement to the magnets 234*a* through 234*f*. The internal magnetic arrays 232 and 236 may be the same as or different from each other.

Each set 242*a* through 242*n* of rotor blades is similar to the sets 142*a* through 142*n* of rotor blades described above. Each set 242*a* through 242*n* of rotor blades comprises a plurality of blades or vanes extending outwardly from a central axis. Each blade or vane is shaped and positioned to push fluid (gas or liquid) when rotated. In the illustrated example, each set 242*a* through 242*n* of rotor blades is aligned for rotation along a common central axis. The sets 242*a* through 242*n* of rotor blades may have any form and arrangement suitable for the desired application. In some applications, movement or an increase in velocity and/or acceleration of the fluid is desired. In some applications, each set of rotor blades is designed to draw in input fluid and compress that fluid into the space behind the set or rotor blades. A series of successive sets of rotor blades may be designed to successively compress the fluid more and more at each set until a desired compression is reached. The rotor blades may be constructed of any suitable material. In some embodiments, the rotor blades may be made of a non-conductive material, such as any of the non-conductive materials previously mentioned.

The system 200 further includes a driving assembly 250. The driving assembly 250 comprises a motor 270, a drive shaft structure 260, a first external magnetic array 252 and a second external magnetic array 256.

The first external magnetic array 252, like the external magnetic array 152, includes an array of magnets 254*a* through 254*f*, wherein the magnets 254*a* through 254*f* are arranged to provide alternating polarity around the outside of the external magnetic array 252. For example, magnets 254*a*, 254*c*, and 254*c* may have outwardly-facing surfaces of south polarity and inwardly-facing surfaces of north polarity, while magnets 254*b*, 254*d*, and 254*f* may have outwardly-facing surfaces of north polarity and inwardly-facing surfaces of south polarity. The magnets may be made of any suitable type of magnet, such as permanent magnets made of neodymium (an alloy of neodymium, iron, and boron). Many variations are possible, including changes to the number, size, shape, and material of the magnets. The second external magnetic array 256 is similar to the first external magnetic array 252, with an array of magnets 258*a* through 258*f* that are similar in description and arrangement to the magnets 254*a* through 254*f*. The external magnetic arrays 252 and 256 may be the same as or different from each other.

Like the magnetic arrays 132 and 152, the magnetic arrays 232, 236, 252, 256 may be mounted to one or more mounting plates or brackets 248, on one or both sides of the magnetic array.

In the fluid-flow assembly 206, the shaft structure 228 is connected to the rotor assembly 230, providing a support for rotation of the rotor assembly 230 relative to the outer tube 208. The shaft or shaft segments 228 may be connected, for example, to the first internal magnetic array 232, the second internal magnetic array 236, one or more of the sets of rotor blades 242*a* through 242*n*, and/or one or more of the mounting supports 248 for the internal magnetic arrays 232, 236.

In the driving assembly 250, a drive shaft structure 260 comprising a rotatable shaft or shaft segments 262*a*, 262*b* is connected to one or more of the external magnetic arrays 252, 256 (and/or one or more of the mounting supports 248 for the external magnetic arrays 252, 256) so that rotation of the shaft or shaft segments rotates the external magnetic arrays 252, 256. The motor 270 is capable of driving the shaft or shaft segments and consequently the external magnetic arrays 252, 256.

When the fluid-flow assembly 206 is assembled, the first bearing assembly 210, the second bearing assembly 220, and the rotor assembly 230 are mounted within the outer tube 208. The fixed bearing supports 212, 222 are connected to the outer tube 208 such that they do not move relative to the outer tube 208, while the shaft or shaft segments of shaft structure 228 is/are free to rotate within the outer tube 208. The rotor assembly 230 is connected (directly or indirectly) to the rotating shaft or shaft segments of the shaft structure 228 such that the rotor assembly 230 rotates within the outer tube 208. The rotor assembly 230 may be connected to the shaft or shaft segments of the shaft structure 228 by a connection at the internal magnetic array 232, at the internal magnetic array 236, at one or more of the sets of rotor blades 242*a* through 242*n*, at a mounting support 248 associated with one of the internal magnetic arrays 232, 236, and/or at another part of the rotor assembly 230. In some embodiments, one or more of the sets of rotor blades 242*a* through 242*n* may be mounted wholly or partially inside the internal magnetic array 232 and/or the internal magnetic array 236. In some embodiments, one or more of the sets of rotor blades 242*a* through 242*n* may be mounted next to the internal magnetic array 232 and/or the internal magnetic array 236.

When the system 200 is assembled, the outer tube 208 (with the first bearing assembly 210, the second bearing assembly 220, and the rotor assembly 230 mounted within the outer tube 208) may be connected to additional components for suitable fluid flow. When the drive assembly 250 is assembled, the external magnetic arrays 252, 256 are connected for rotation by the rotatable shaft or shaft segments of the drive shaft structure 260, driven by the motor 270.

Additional components may be incorporated depending on the application. For example, tubing and/or an inlet valve may be connected upstream of the outer tube 208. Tubing and/or an outlet valve may be connected downstream of the outer tube 208. Other components may be incorporated for supplying, directing, controlling, and/or utilizing the fluid directed into or out of the sets of rotor blades 242*a* through 242*n*.

As shown in FIG. 2 in phantom lines, the system 200 may include a plurality of driving assemblies 250, 250*a*, 250*b*, etc. The additional driving assemblies 250*a*, 250*b*, etc., may be similar to the driving assembly 250 in that each comprises at least one external magnetic array for driving, or assisting in driving, the rotor assembly 230 and sets of rotor blades 242*a* through 242*n*. As illustrated, one or more additional driving assemblies may be positioned to magnetically drive an adjacent driving assembly to provide additional rotating force in that driving assembly. Additionally or alternatively, one or more additional driving assemblies may be positioned to magnetically drive the rotor assembly directly. For example, two driving assemblies may be positioned on either side of the driven assembly (rotor assembly 230). In another example, six driving assemblies may be positioned in a hexagonal arrangement around the driven assembly (rotor assembly 230).

In use, the motor 270 is used to rotate the external magnetic arrays 252, 256. The external magnetic arrays 252, 256 are magnetically coupled to the internal magnetic arrays 232, 236, such that rotation of the external magnetic arrays 252, 256 causes rotation of the internal magnetic arrays 232, 236. The action of the external magnetic arrays 252, 256 upon the internal magnetic arrays 232, 236 is due to the magnetic forces and occurs without physical contact between the arrays. The internal magnetic arrays 232, 236 are caused to rotate within the outer tube 208 without the need for mechanical coupling to any drive mechanism. For example, the internal magnetic arrays 232, 236 are caused to rotate within the outer tube 208 without the need for a drive shaft or other driving component located within the outer tube 208 or within the fluid flow stream at all.

The rotation of the internal magnetic arrays 232, 234 cause rotation of the sets of rotor blades 242*a* through 242*n*, causing the desired fluid flow. In the illustrated embodiment, the fluid flow is axial, generally in the direction of the axis of the outer tube 208 and the axis of rotation of the sets of rotor blades 242*a* through 242*n*.

As with system 100 and other systems described herein, in alternative embodiments of the system 200, the driving assembly or assemblies may comprise at least one external magnet, wherein the at least one external magnet comprises at least one electromagnet. The electromagnet(s) may be arranged and actuated as described above.

Figure 3:
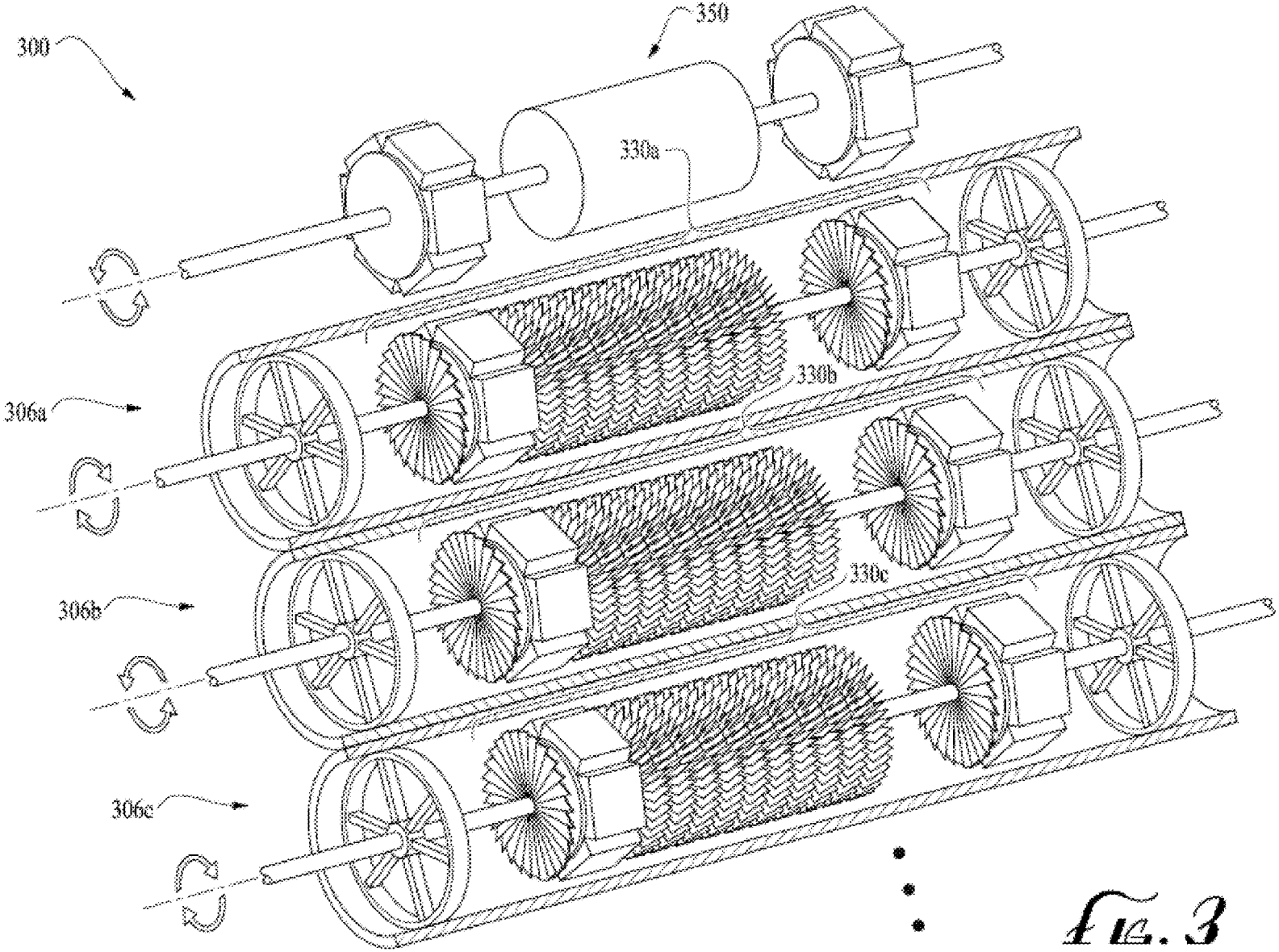
FIG. 3 shows a perspective view, partially in cross-section, of a third example of a fluid-flow system with a magnetic rotor assembly.

FIG. 3 shows a perspective view, partially in cross-section, of a third example of a fluid-flow system 300 including fluid-flow assemblies 306*a*, 306*b*, 306*c* having magnetic rotor assemblies 330*a*, 330*b*, 330*c*, respectively.

Each of the fluid flow assemblies 306*a*, 306*b*, 306*c* is similar to the fluid-flow assembly 206. Each fluid flow assembly 306*a*, 306*b*, 306*c* includes an outer tube, at least one rotor assembly including at least one internal magnetic array and one or more sets of rotor blades, and a bearing assembly allowing the rotor assembly to rotate within the outer tube. For an understanding of the structure and function of the components of the fluid flow assemblies 306*a*, 306*b*, 306*c*, reference is made to the above description of the fluid-flow assembly 206.

The system 300 further includes a driving assembly 350. The driving assembly 350 is similar to the driving assembly 250, including a motor, a drive shaft structure, and at least one external driving magnetic array. For an understanding of the structure and function of the components of the driving assembly 350, reference is made to the above description of the driving assembly 250.

In the system 300 of FIG. 3, the drive assembly 350 drives rotation of the rotor assembly 330*a* in the adjacent fluid-flow assembly 306*a*. The magnets in the rotor assembly 330*a* in the fluid-flow assembly 306*a* in turn drive rotation of the rotor assembly 330*b* in the adjacent fluid-flow assembly 306*b*. The magnets in the rotor assembly 330*b* in the fluid-flow assembly 306*b* in turn drive rotation of the rotor assembly 330*c* in the adjacent fluid-flow assembly 306*c*.

As illustrated, one or more additional fluid-flow assemblies may be positioned to be magnetically driven by an adjacent fluid-flow assembly. Additionally or alternatively, one or more additional fluid-flow assemblies may be positioned to be magnetically driven by the driving assembly 350 directly. For example, two fluid-flow assemblies may be positioned on either side of the driving assembly, so that the driving assembly drives both fluid-flow assemblies. In another example, six fluid-flow assemblies may be positioned in a hexagonal arrangement around the driving assembly, so that the driving assembly drives all six fluid-flow assemblies. Thus, a single driving assemblies can drive a single or multiple fluid-flow assemblies, and multiple driving assemblies can drive a single or multiple fluid-flow assemblies. The additional driving assemblies can increase the available torque.

As with systems 100, 200 and other systems described herein, in alternative embodiments of the system 300, the driving assembly or assemblies may comprise at least one external magnet, wherein the at least one external magnet comprises at least one electromagnet. The electromagnet(s) may be arranged and actuated as described above.

In certain applications, multiple fluid-flow assemblies may be placed in series to act on the same fluid flow in succession. In certain embodiments, multiple rotor assemblies may be provided in succession to alternate the direction of rotation of the successive rotor blades. For example, a first set of rotor blades may be rotated clockwise while a following set of rotor blades may be rotated counterclockwise. Many sets of rotor blades may be used in sequence with different arrangements, some in clockwise rotation and others in counterclockwise rotation.

Many variations of these embodiments are possible. For example, the fluid-flow assemblies may be provided without outer tubes. The fluid-flow may be driven by the sets of rotor blades or may drive the sets of rotor blades. While the illustrated embodiments have been described in terms of driving magnetic rotor assemblies to drive a fluid flow, they may also be adapted such that a fluid flow drives a magnetic rotor assembly. For example, one or more sets of rotor blades connected to an internal magnetic rotor assembly may be placed in a fluid flow stream. As examples, the fluid flow stream may be water as in a hydroelectric generator or wind as in a wind generator or steam as in a steam generator. The fluid flow turns the rotor blades, which in turn drives the internal magnetic rotor assembly. In the example embodiment of a generator, the internal magnetic rotor assembly may actuate one or more external magnets for generating current. For example, rotation of the internal magnetic rotor assembly may drive one or more external magnetic rotor assemblies for generating current in adjacent coils. In other examples, rotation of the internal magnetic rotor assembly may induce a current flow in one or more electromagnets that is/are positioned outside the internal magnetic rotor assembly.

The cross-section of the magnets in the illustrated embodiments has one side that is straight and an opposite side that is curved, with the magnets arranged in the rotor so that the curved side faces inwardly and the straight side faces outwardly. In the illustrated examples, as can be seen in the drawings, while the magnets may touch each other (or not) at the inner perimeter of the array, there are gaps between the magnets, and the gaps are largest at the outer perimeter of the array. The choice of magnet geometry can be selected for the desired application. In alternative embodiments of magnet shapes, both the outside surface and the inside surface can be straight, both can be curved, or they can be any other suitable shape.

The number of magnetic rotors that can be positioned in a single arrangement is unlimited. For example, for a particular application, it is possible to have dozens, hundreds, or even more magnetic rotors as described herein in a single arrangement.

A system as described herein can be used in a variety of applications. For example, a system as described herein may be used as a pump, compressor, water turbine, wind turbine, steam turbine, or propeller for air or water craft. A system as described herein may be used for fluid transport. A system as described herein may be used for medical devices. A system as described herein may be used in a generator or engine. The design allows for a closed system with axial flow which has commercial use in a number of applications, such as pumps, compressors, water turbines, wind turbines, steam turbines, and vehicular transport. The system may be used in regenerative energy systems and in underwater and outer space applications.

Systems as described herein can provide numerous advantages. In certain embodiments, fluid flow can be accomplished at high speeds or at any desired speed. In certain embodiments, the elimination of certain contacting parts can increase efficiency, reduce wear, and reduce costs. In certain embodiments, the system may be practiced as a closed system without the need for shafts or other components penetrating the fluid-flow assembly to transfer power to the rotor blades. This has advantages in terms of performance, reducing potential for contamination, reducing potential for failure, etc. This can be advantageous in a number of applications, such as in the pharmaceutical industry or in transport of explosive liquids like oil or propane. Depending on the embodiment, advantages can include improved performance, reduced mechanical complications, reduced power requirements, less disturbance of fluid flow, less potential for leakage, less potential for contamination, reduced wear, reduced weight, reduced cost, increased service life, and/or reduced need for service, repair, and/or replacement of parts.

Figure 4:
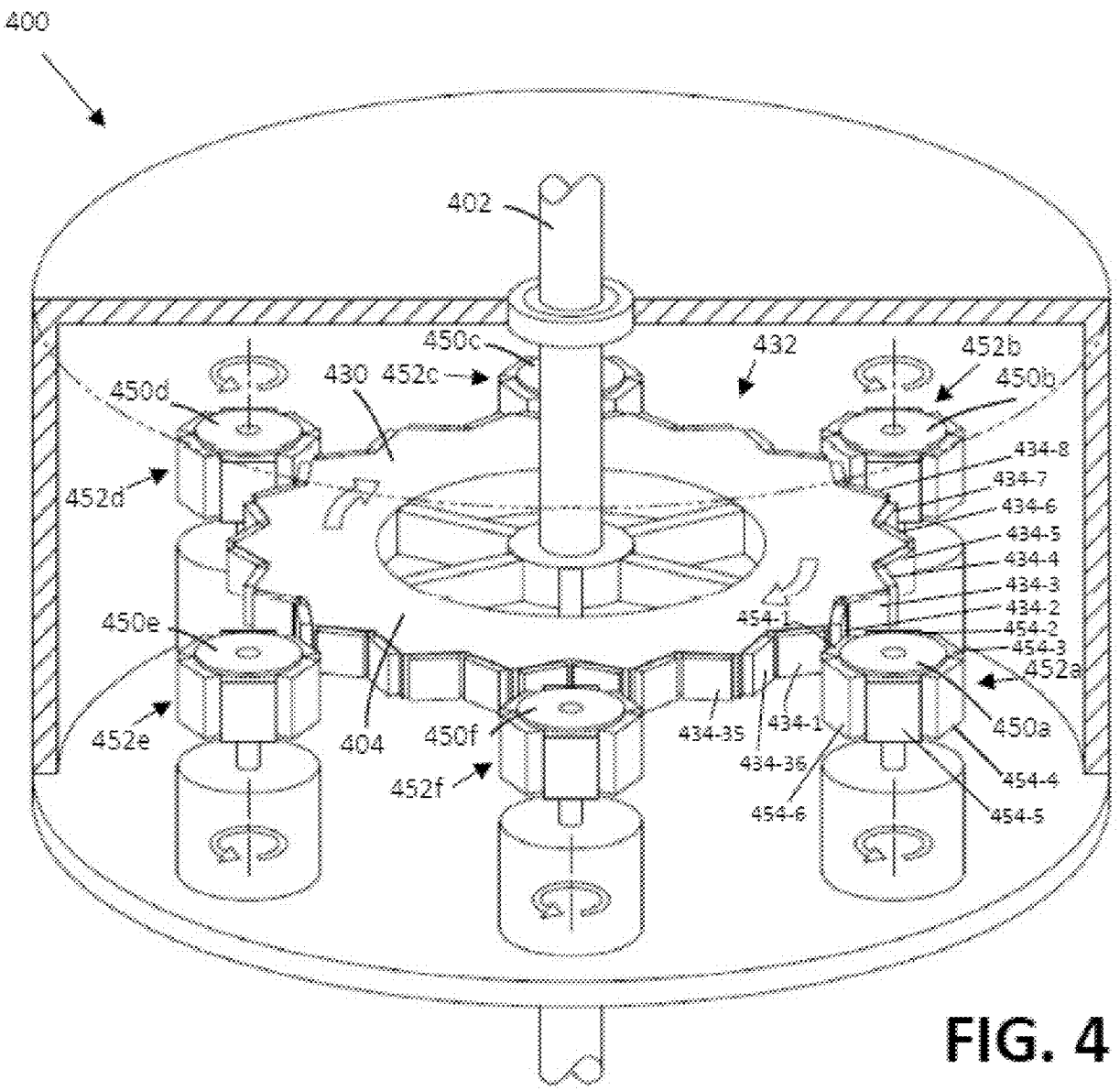
FIG. 4 shows a perspective view of another example of a magnetic rotor system.

Some embodiments of the inventions described herein relate to improvements in magnetic rotor designs and/or improvements over gear systems. FIG. 4 shows an example of a magnetic rotor system 400 incorporating improvements in magnetic rotor designs.

The example magnetic rotor system 400 may be used as a step-up or step-down arrangement. In a step-up arrangement, an input rotational speed is converted to an increased rotational speed. In a step-down arrangement, an input rotational speed is converted to a decreased rotational speed, with increased output torque in some applications.

The system 400 includes a first magnetic rotor 430 that includes a magnetic array 432 with an array of magnets 434-1 through 434-36. In this example, the array has 36 magnets, but any suitable number of magnets may be used. The magnets 434-1 through 434-36 are arranged to provide alternating polarity around the outside of the magnetic array 432 and consequently the rotor assembly 430. In one example, the magnets 434-1 through 434-36 are arranged in alternating pairs of similar orientation. For example, magnets 434-1 and 434-2 may have outwardly-facing surfaces of north polarity and inwardly-facing surfaces of south polarity, while magnets 434-3 and 434-4 may have outwardly-facing surfaces of south polarity and inwardly-facing surfaces of north polarity. Continuing around the perimeter of the rotor 430, this pattern may be repeated. For example, magnets 434-5 and 434-6 may have outwardly-facing surfaces of north polarity and inwardly-facing surfaces of south polarity, while magnets 434-7 and 434-8 may have outwardly-facing surfaces of south polarity and inwardly-facing surfaces of north polarity. This pattern may continue around the entire perimeter of the rotor 430. Thus, the magnets 434-35 and 434-36 may have outwardly-facing surfaces of south polarity and inwardly-facing surfaces of north polarity. In an alternative example, the polarity may alternate at each magnet, i.e., one magnet having an outwardly-facing north polarity, the next having an outwardly-facing south polarity, the next having an outwardly-facing north polarity, and so on around the array. While the illustrated example has the magnets arranged in alternating pairs of similar orientation, in alternative examples the magnets may be in any other suitable arrangement, such as groups of three (or more) magnets of one orientation alternating with similarly-numbered groups of magnets of the opposite orientation.

The magnets may be made of any suitable type of magnet, such as permanent magnets made of neodymium (an alloy of neodymium, iron, and boron). Many variations are possible, including changes to the number, size, shape, and material of the magnets.

The example system 400 also includes second magnetic rotors 450*a* through 450*f* having magnetic arrays 452*a* through 452*f*, respectively. Each of the magnetic arrays 452*a* through 452*f* includes an array of magnets 454-1 through 454-6, wherein the magnets 454-1 through 454-6 are arranged to provide alternating polarity around the outside of the magnetic array. For example, magnets 454-1, 454-3, and 454-5 may have outwardly-facing surfaces of south polarity and inwardly-facing surfaces of north polarity, while magnets 454-2, 454-4, and 454-6 may have outwardly-facing surfaces of north polarity and inwardly-facing surfaces of south polarity. Similar to the first magnetic rotor 430, the alternating polarity may be provided by alternating groups of magnets (e.g., pairs, groups of three, etc.), with the magnets in each group being similarly-oriented. Also, similar to the first magnetic rotor 430, the magnets may be made of any suitable type of magnet, such as permanent magnets made of neodymium (an alloy of neodymium, iron, and boron). Many variations are possible, including changes to the number, size, shape, and material of the magnets.

Each magnetic array 452*a* through 452*f* does not physically contact but is magnetically coupled to the magnetic array 432. In one embodiment, a step-up system, rotation of the magnetic array 432 causes rotation through magnetic coupling of the magnetic arrays 452*a* through 452*f*. In such an example, the input is to the magnetic array 432, which serves as the driving array. The magnetic arrays 452*a* through 452*f* are the driven arrays, which provide output. In another embodiment, a step-down system, rotation of one or more of the magnetic arrays 452*a* through 452*f* causes rotation through magnetic coupling of the magnetic array 432. In such an example, the input is to one or more of the magnetic arrays 452*a* through 452*f*, which serve(s) as the driving array(s). The magnetic array 432 is the driven array, which provides output. The rotational interaction of the magnetic arrays is due to the magnetic forces and occurs without physical contact between the arrays. The rotational interaction occurs without the need for mechanical coupling of the arrays.

The input for the driving array(s) may be any suitable input, depending upon the application. For example, input may be provided by a motor, engine, electromagnet(s), coils, rotor blade(s), and/or turbine, etc., with or without a drive shaft. The motive force may be provided by electricity, fuel, wind, water, etc. One or more components, gears, arrays, etc., may be provided between the input source and the driving array(s).

The output from the driven array(s) may be any suitable output, depending upon the application. For example, output may be provided to a generator, electromagnet(s), coils, rotor blade(s), and/or turbine, etc., with or without a drive shaft. One or more components, gears, arrays, etc., may be provided between the driven array(s) and the output destination.

As with earlier-described embodiments, the cross-section of the magnets in the system 400 or another system or device may have one side that is straight and an opposite side that is curved, with the magnets arranged in the rotor so that the curved side faces inwardly and the straight side faces outwardly. In such an arrangement, the magnets may touch each other (or not) at the inner perimeter of the array, while there may be gaps between the magnets, which may be largest at the outer perimeter of the array. The choice of magnet geometry can be selected for the desired application. In alternative embodiments of magnet shapes, both the outside surface and the inside surface can be straight, both can be curved, or they can be any other suitable shape. In any such arrangement, there may be places where the magnets touch and do not touch.

Figure 5:
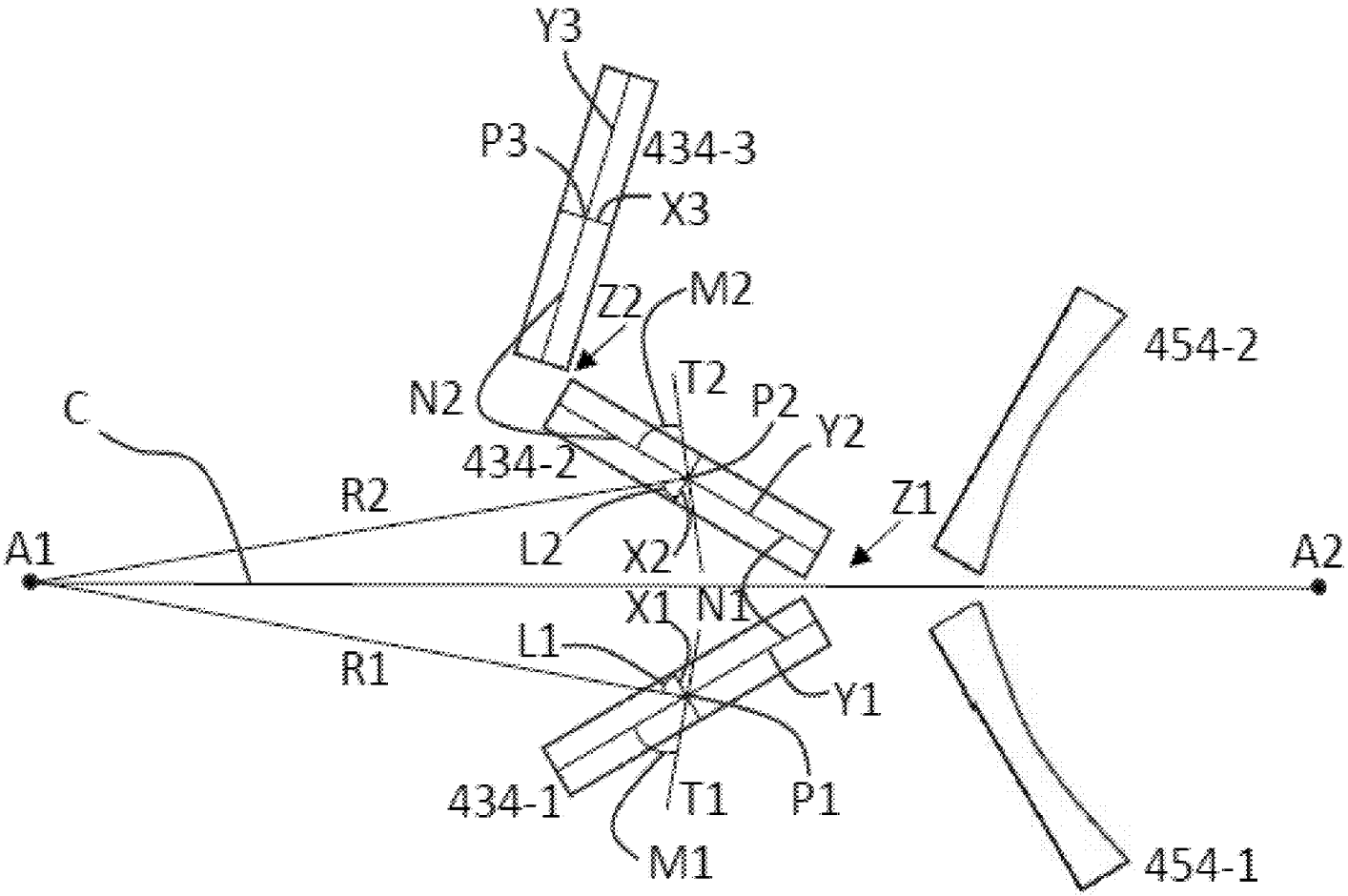
FIG. 5 shows an enlarged view of certain magnets of the system of FIG. 4.

FIG. 5 shows an enlarged view of certain magnets of the system 400 of FIG. 4. Magnets 434-1, 434-2, and 434-3 of the first magnetic rotor 430 are shown, adjacent to magnets 454-1 and 454-2 of a second magnetic rotor 450. Also illustrated is a centerline C that passes through the axis of rotation A1 of the first magnetic rotor 430 and through the axis of rotation A2 of the second magnetic rotor 450.

Each of the magnets has a magnetic axis, which is the straight line joining the two poles of the magnet. In the illustrated example, each of the magnets 434-1, 434-2, and 434-3 has a magnetic axis X1, X2, and X3, respectively. Each of the magnets 434-1, 434-2, and 434-3 has a center point P1, P2, and P3, respectively, that lies on its magnetic axis between its poles. Each of the magnets 434-1, 434-2, and 434-3 has an orientation axis Y1, Y2, and Y3, respectively, that passes through its center point and is perpendicular to its magnetic axis. In FIG. 5, a radius R1 is illustrated that passes through the axis of rotation A1 of the first magnetic rotor 430 and the center point P1 of the magnet 434-1, and a radius R2 is illustrated that passes through the axis of rotation A1 of the first magnetic rotor 430 and the center point P2 of the magnet 434-2. Tangent lines T1 and T2 are shown perpendicular to the radii R1 and R2, respectively.

As can be seen in FIGS. 4 and 5, the magnets in the magnetic rotor 430 are aligned at angles around the perimeter of the rotor. In other designs, each of the magnets is positioned with its magnetic axis aligned along a radius of the rotor. However, in the rotor 430 the magnetic axis X1 of the magnet 434-1 is not aligned along the radius R1, and the magnetic axis X2 of the magnet 434-2 is not aligned along the radius R2. Instead, the magnetic axis X1 of the magnet 434-1 is oriented at an angle L1 to the radius R1, and the magnetic axis X2 of the magnet 434-2 is oriented at an angle L2 to the radius R2. The angles L1 and L2 may be any suitable angle, and they may be the same or different. In one example, the angles L1 and L2 are 30 degrees. Many other angles for L1 and L2 are possible, such as 10 degrees, 15 degrees, 20 degrees, 45 degrees, 60 degrees, 70 degrees, 75 degrees, 80 degrees, or any other suitable angles.

In other designs, the magnets may be aligned with the circumference of the rotor or tangents to the circumference of the rotor. However, in the rotor 430 the orientation axis Y1 of the magnet 434-1 is not aligned with the tangent T1 of the radius R1, and the orientation axis Y2 of the magnet 434-2 is not aligned with the tangent T2 of the radius R2. Instead, the orientation axis Y1 of the magnet 434-1 is oriented at an angle M1 to the tangent T1 of the radius R1, and the orientation axis Y2 of the magnet 434-2 is oriented at an angle M2 to the tangent T2 of the radius R2. The angles M1 and M2 may be any suitable angle, and they may be the same or different. In one example, the angles M1 and M2 are 30 degrees. Many other angles for M1 and M2 are possible, such as 10 degrees, 15 degrees, 20 degrees, 45 degrees, 60 degrees, 70 degrees, 75 degrees, 80 degrees, or any other suitable angles.

The angling of the magnets around the perimeter of the rotor 430 creates a star-shaped design. The design is in the form of a non-convex polygon. That is, at least one of the angles points inwards, i.e., at least one of the angles is an interior reflex angle. In other words, the shape defined by the array 432 of magnets has at least one internal angle N2 that is greater than 180 degrees. In the example illustrated, the interior angles of the shape defined by the array 432 of magnets alternate between angles less than 180 degrees (e.g., angle N1) and angles more than 180 degrees (e.g., angle N2) around the perimeter of the rotor.

This star-shaped design results in outwardly-facing nodes Z1 and inwardly-facing nodes Z2. In some designs, a gap, which may be angled or wedge-shaped, may be present between adjacent magnets at the nodes Z1 and/or Z2. In one example, the node Z1 has a gap angle (similar to the angle formed by the extensions of X1 and X2) of 60 degrees, but any suitable angle or arrangement is possible. The star-shaped design results in unique magnetic field properties and unique operational aspects of the rotor.

When paired with a rotor like rotor 450, when the magnets 434-1 through 434-36 are at their closest points adjacent the magnets 454-1 through 454-6, the faces of the magnets 434-1 through 434-36 are not parallel to the faces of the magnets 454-1 through 454-6. This pairing of a non-convex polygon shaped (e.g., star shaped) magnetic array 432 with a convex polygon shaped (e.g., hexagonal) magnetic array 452 results in unique interactions of magnetic fields and unique operational aspects of the interacting rotors. In alternative embodiments, the interacting arrays 432, 452 may both be non-convex polygon shaped (e.g., star shaped).

With reference again to FIG. 4, it can be seen that the number of polarity changes around the perimeter of the rotor 430 is not equal to the number of polarity changes around the perimeter of the rotor 450. When the magnets are arranged in pairs of like polarity around the perimeter of rotor 430, the rotor 430 has 18 polarity changes around its perimeter (18 pairs of magnets). This is compared to 6 polarity changes around the perimeter of each of the rotors 450*a-f*. In a step-up example arrangement, with the driving rotor being the rotor 430 with the larger number of polarity changes, an input rotational speed of driving rotor 430 is converted to an increased rotational speed in the driven rotors 450*a-f*. In a step-down example arrangement, with the driving rotor(s) being one or more of the rotors 450*a-f* with the smaller number of polarity changes, an input rotational speed of driving rotor(s) 450 is converted to a decreased rotational speed of the driven rotor 430, with increased output torque in certain applications. Thus, a system as described herein may be used to direct a kinetic force through a series of magnetic rotors to change rotational speed.

In just one of many possible examples, a system like the illustrated system 400 may include a first magnetic rotor 430 that includes a magnetic array 432 with an array of 24 magnets arranged in alternating pairs of similar orientation, thereby resulting in 12 polarity changes around its circumference. A second magnetic rotor 450 may include a magnetic array 452 with 6 magnets of alternating polarity, thereby resulting in 6 polarity changes around its circumference.

In an example embodiment, the magnetically coupled rotor system 400 in FIG. 4 may include a shaft 402 connected to a large diameter rotating disc 404 with a circumference of the alternately polarized pairs of magnets 434-1 through 434-36 that couple with the alternately polarized magnets 454-1 through 454-6 in the smaller-diameter planetary arrays 452*a* through 452*f*. In one example, the arrays 452*a*-452*f* can be connected with generator motors or have internal field windings that allow for electrical current to be generated and transferred via a conductor. Conductors can be wires, conductive sheet material, or any other suitable conductive material. The system may be connected via a shaft (e.g., shaft 402) to a turbine blade design to capture kinetic energy from wind, water, wave, steam, regenerative power, or other forces. The larger diameter flywheel 404 increases the velocity of the smaller planetary arrays 452*a*-452*f* through the magnetically coupled system. This type of system may also be reversed, with the planetary arrays 452*a*-452*f* driving the larger diameter flywheel 404. The flywheel 404 may be connected to a shaft (e.g., shaft 402) for output for a variety of applications. As just one of many examples, the system may be designed into transportation devices, for example in power trains or transmissions. This type of step-up or step-down system may be used to change rotational speed and/or torque in the magnetically coupled system.

The assembly may have any number of magnetically coupled central or planetary arrays. The arrays may be comprised of any size and shape of magnets. In some embodiments the larger diameter flywheel and/or the smaller diameter planetary arrays may be comprised of different shaped magnets.

Magnetic rotor designs as disclosed herein may be used for a variety of applications. For example, magnetic rotor designs as disclosed herein may be used for electric motors and generators, transportation systems, drones and watercraft, stabilization and navigational devices such as gyroscopes, centrifuges, scientific measuring devices, Micro-Electro-Mechanical Systems (MEMS) and microgenerators.

In some embodiments, the magnetically coupled flywheel may be connected to a shaft with a Horizontal Axis Wind Turbine (HAWT) and coupled to generator/motors inside the upper cowling. Electric current may be generated and transferred through wire conductors to a base of a transmission tower.

In some embodiments, the assembly may be attached to a Vertical Axis Wind Turbine (VAWT), and the rotor array may be placed underground or as a buoy for offshore power generation. The blade assembly and design may be modified to react to both wave and wind based offshore capabilities.

In some embodiments, the magnetically coupled planetary rotor arrays may be connected to motor drivers, and the power may be transferred through the magnetic coupling to the larger diameter flywheel. This type of system transfers the input from the multiple drive rotors to the central flywheel, which may be connected to a shaft, to slow rpm and add torque to the central shaft.

In some embodiments, the central shaft may be connected to multiple stacked larger diameter flywheels and any number of magnetically coupled planetary arrays. Any number of larger and smaller diameter arrays may be used.

in some embodiments, the rotor or impeller blades may be of any size and shape and may be placed into turbine designs. The designs may include any number of blades in any suitable orientation. The designs may be adapted to capture and transfer kinetic energy to a magnetically coupled generator motor system. The rotor or impeller blades may be of any suitable material, such as fiberglass, carbon fiber, aluminum, etc.

Systems as described herein can provide various advantages. Some known systems for changing operational speeds or torque use gear boxes with gears that are mechanically engaged, either by direct gear meshing or by a chain. These systems experience friction and wear due to the mechanical gear engagement. In certain systems in accordance with the disclosure, operational speeds and/or torque can be increased or decreased as desired without a mechanical gear interface and its associated friction and wear.

Other systems incorporating one or more of the magnetic rotor design aspects disclosed herein also provide advantages over prior systems. Depending on the embodiment, advantages can include increased torque, elimination or minimization of slippage, improved performance, improved efficiency, reduced mechanical complications, reduced power requirements, reduced weight, reduced wear, reduced cost, increased service life, and/or reduced need for service, repair, and/or replacement of parts.

The foregoing embodiments are merely examples. Other embodiments are possible that incorporate one or more of the features and/or advantages of the above-described embodiments. This invention thus embraces other embodiments within the scope of the claims.

What is claimed is:

1. A magnetic rotor system comprising:

a first magnetic array comprising magnets arranged to provide alternating polarity around the outside of the first magnetic array; and a second magnetic array comprising magnets arranged to provide alternating polarity around the outside of the second magnetic array;

wherein the first magnetic array and the second magnetic array are not in physical contact with each other;

wherein the first magnetic array and the second magnetic array are arranged such that when one of the first magnetic array and the second magnetic array is rotated, the rotation induces rotation of the other of the first magnetic array and the second magnetic array; and wherein at least one magnet in the first magnetic array has a magnetic axis comprising a straight line through north and south poles of the at least one magnet and a center point that lies on its magnetic axis, wherein the magnetic axis is angled with respect to an array radius extending from an axis of rotation of the first magnetic array to the center point of the at least one magnet, such that the magnetic axis of the at least one magnet is non-parallel with and non-perpendicular to the array radius.

2. The magnetic rotor system according to claim 1, wherein the magnets in the first magnetic array form a non-convex polygon, and the magnets in the second magnetic array also form a non-convex polygon.

3. The magnetic rotor system according to claim 1, wherein the magnets in the first magnetic array form a non-convex polygon, and the magnets in the second magnetic array form a convex polygon.

4. The magnetic rotor system according to claim 3, wherein the magnets in the second magnetic array form a hexagon.

5. The magnetic rotor system according to claim 1, wherein the at least one magnet has one side that is straight and an opposite side that is curved.

6. The magnetic rotor system according to claim 5, wherein the at least one magnet is arranged in the first magnetic array so that its curved side faces inwardly and its straight side faces outwardly.

7. The magnetic rotor system according to claim 1, wherein the magnets in the first magnetic array are arranged such that a shape defined by the first magnetic array comprises at least one interior reflex angle.

8. The magnetic rotor according to claim 1, wherein the magnets in the first magnetic array are arranged such that a polygon shape defined by the first magnetic array comprises outwardly-facing nodes and wherein the magnets in the first magnetic array are arranged with gaps between adjacent magnets.

9. The magnetic rotor according to claim 1, wherein the magnets in the first magnetic array are arranged such that a polygon shape defined by the first magnetic array comprises inwardly-facing nodes and wherein the magnets in the first magnetic array are arranged with gaps between adjacent magnets.

10. The magnetic rotor according to claim 1:

wherein the first magnetic array has a first number of polarity changes around the outside of the first magnetic array;

wherein the second magnetic array has a second number of polarity changes around the outside of the second magnetic array; and wherein the second number of polarity changes differs from the first number of polarity changes.

11. The magnetic rotor system according to claim 10, wherein the first number of polarity changes is greater than the second number of polarity changes, and wherein rotation of the first magnetic array at a first rotational velocity drives rotation of the second magnetic array at a second rotational velocity that is higher than the first rotational velocity.

12. The magnetic rotor system according to claim 10, wherein the first number of polarity changes is smaller than the second number of polarity changes, and wherein rotation of the first magnetic array at a first rotational velocity drives rotation of the second magnetic array at a second rotational velocity that is lower than the first rotational velocity.

13. The magnetic rotor system according to claim 1, wherein the magnets in the first magnetic array form a star shape.

14. The magnetic rotor system according to claim 1, wherein the magnets in the first magnetic array form a non-convex polygon.

15. The magnetic rotor system according to claim 1, wherein the magnets in the first magnetic array are arranged in alternating pairs of similar magnetic orientation.

16. The magnetic rotor system according to claim 1, wherein the magnets in the first magnetic array are arranged in alternating groups of three or more magnets, wherein the magnets within each group have a similar magnetic orientation.

17. The magnetic rotor system according to claim 1, wherein the magnets in the first magnetic array are arranged such that a shape defined by the first magnetic array comprises interior angles that alternate between angles less than 180 degrees and angles more than 180 degrees around a perimeter of the first magnetic array.

18. The magnetic rotor system according to claim 1, wherein the magnets in the first magnetic array are arranged with gaps between adjacent magnets.

19. A magnetic rotor system comprising:

a first magnetic array comprising a plurality of magnets arranged to provide alternating polarity around the outside of the first magnetic array; and a second magnetic array comprising a plurality of magnets arranged to provide alternating polarity around the outside of the second magnetic array;

wherein the first magnetic array and the second magnetic array are not in physical contact with each other;

wherein the first magnetic array and the second magnetic array are arranged such that when one of the first magnetic array and the second magnetic array is rotated, the rotation induces rotation of the other of the first magnetic array and the second magnetic array;

wherein each magnet in the plurality of magnets of the first magnetic array has a magnetic axis comprising a straight line through north and south poles of the magnet and a center point that lies on its magnetic axis;

wherein each magnet in the plurality of magnets of the first magnetic array has an orientation axis that passes through its center point and is perpendicular to its magnetic axis;

wherein the orientation axes of the magnets in the plurality of magnets of the first magnetic array together form a non-convex polygon.

20. The magnetic rotor system according to claim 19, wherein the plurality of magnets in the first magnetic array are arranged in alternating groups of two or more magnets, wherein the magnets within each group have a similar magnetic orientation.

21. The magnetic rotor system according to claim 19, wherein at least one magnet in the plurality of magnets of the first magnetic array has one side that is straight and an opposite side that is curved.

22. The magnetic rotor system according to claim 19, wherein the non-convex polygon comprises inwardly-facing nodes and the first magnetic array comprises gaps between adjacent magnets at the inwardly-facing nodes.

23. The magnetic rotor system according to claim 19, wherein the non-convex polygon comprises outwardly-facing nodes and the first magnetic array comprises gaps between adjacent magnets at the outwardly-facing nodes.

* * * * *